US006019293A

United States Patent [19]

Sweazy et al.

[11] Patent Number: 6,019,293

[45] Date of Patent: Feb. 1, 2000

[54] DOMED AIR CAP

[75] Inventors: John D. Sweazy, Eden Prairie; Ken C. Floer, Crystal, both of Minn.

[73] Assignee: Graco Inc, Minneapolis, Minn.

[21] Appl. No.: 09/078,838

[22] Filed: May 14, 1998

Related U.S. Application Data

[60] Provisional application No. 60/046,565, May 15, 1997.

[51] Int. Cl.[7] ..... B05B 1/28

[52] U.S. Cl. ..... 239/296; 239/290

[58] Field of Search ..... 239/290–297

[56] References Cited

U.S. PATENT DOCUMENTS

| | | | |
|---|---|---|---|
| 1,463,332 | 7/1923 | Parker et al. | 239/296 |
| 2,737,415 | 3/1956 | Wheeler-Nicholson | 239/290 X |
| 3,463,395 | 8/1969 | Binoche | 239/296 X |
| 5,152,460 | 10/1992 | Barty | 239/290 |
| 5,199,644 | 4/1993 | Haferkorn | 239/296 |
| 5,249,746 | 10/1993 | Kaneko et al. | 239/296 |
| 5,322,221 | 6/1994 | Anderson | 239/291 |

FOREIGN PATENT DOCUMENTS

| | | | |
|---|---|---|---|
| 703317 | 4/1931 | France | 239/290 |

*Primary Examiner*—Lesley D. Morris
*Attorney, Agent, or Firm*—Douglas B. Farrow

[57] ABSTRACT

The invention is concentrated at the front end of such an air spray or HVLP gun and in particular details the relationship between the exterior of the fluid nozzle and the inside of the air cap. In particular, the fluid nozzle has a generally frustoconical outer surface which forms an included angle of about 50°. The inside of the air passage at its rearward end has an included angle of about 20° and then curves gently to the point where it is adjacent to the front of the air cap to form a domed inner surface.

1 Claim, 2 Drawing Sheets

DOMED AIR CAP

This application claims the benefit of U.S. Provisional Application Ser. No. 60/046,565 filed May 15, 1997.

BACKGROUND OF THE INVENTION

Spray guns using the air spray method of atomization along with its HVLP variant have been known for a number of years. While such application devices are generally capable of producing a n excellent finish, there is always room for improvement. Such guns are produced by any number of manufacturers including Graco Inc., the assignee of the instant invention.

SUMMARY OF THE INVENTION

The instant invention is concentrated at the front end of such an air spray or HVLP gun and in particular details the relationship between the exterior of the fluid nozzle and the inside of the air cap. In particular, the fluid nozzle has a generally frustoconical outer surface which forms an included angle of about 50°. The inside of the air passage at its rearward end has an included angle of about 20° and then curves gently to the point where it is adjacent to the front of the air cap.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
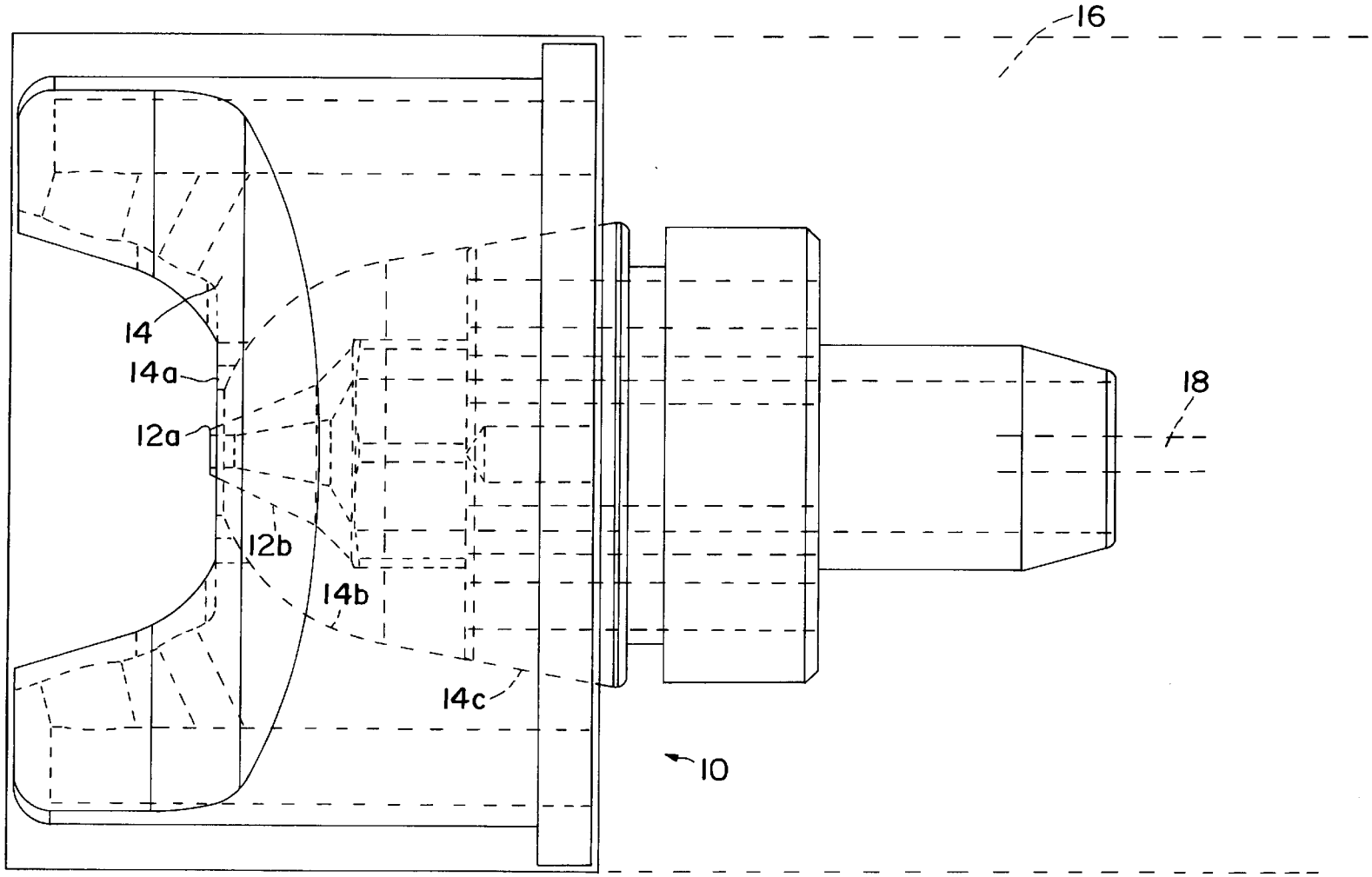
FIG. 1 is a cross-sectional view of the front end of the spray gun of the instant invention.
Figure 2:
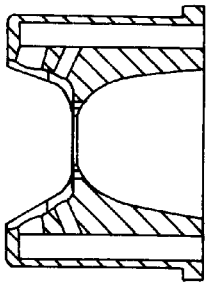
FIG. 2 is a cross-sectional view of the air cap of the instant invention.
Figure 3:
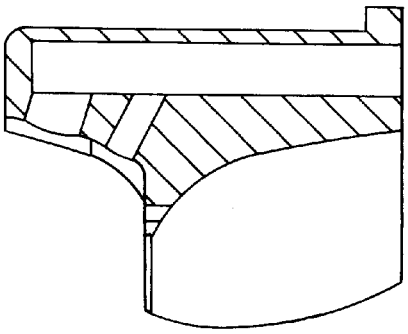
FIG. 3 is a detail cross-sectional view of the air cap of the instant invention.
Figure 4:
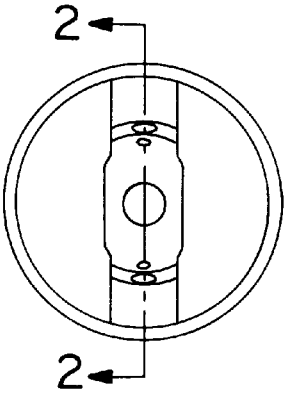
FIG. 4 is a front view of the front end of the air cap of the instant invention.

The instant invention generally shown in FIG. 1 and generally designated 10 is comprised of a fluid nozzle 12 having a front end 12*a* which extends to the front end of air cap 14. Air cap 14 has an opening 14*a* therein through which nozzle front end 12*a* extends. Nozzle surface 12*b* has an angle of approximately 25° relative to the longitudinal axis of the spray gun or a total angle of about 50°. Spray gun 16 also includes a needle 18.

The inside surface of air cap 14 forms a rounded dome 14*b* which merges from being nearly parallel to the longitudinal axis at its rearward end 14*c* (an included angle of 20°) to opening 14*a*.

In one version of the preferred embodiment (for a particular size nozzle/cap combination), the diameter of the dome at its rearward end 14*c* is 0.750 in. and tapers at the aforesaid 20° included angle to a point where it intersects with the dome having a radius of 0.360. Opening 14*a* has a diameter of about 0.210 for use with a nozzle orifice of 0.042–0.055. Utilization of this construction insures maximum air flow and enhanced atomization while utilizing a given amount of air input pressure and volume.

It is contemplated that various changes and modifications may be made to the spray gun without departing from the spirit and scope of the invention as defined by the following claims.

What is claimed is:

1. In an air spray gun comprising a longitudinal axis, a fluid nozzle and an air cap having a pair of air horns, the improvement comprising:

said fluid nozzle extending through said air cap and comprising a frustoconical outer surface, said outer surface having an angle of approximately 25° relative to said longitudinal axis; and said air cap comprising a domed curving inner surface having a rearward end having an included angle of approximately 20° and a forward end with a nozzle opening therein, said inner surface having a curve radius of approximately 0.360 in. and forming an annular opening between said nozzle and said air cap.

* * * * *